US006009815A

United States Patent [19]

Hartman

[11] Patent Number: 6,009,815

[45] Date of Patent: Jan. 4, 2000

[54] STABILIZED TABLE, STABILIZER FOR TABLES, AND METHOD OF STABILIZING TABLES

[75] Inventor: Michael W. Hartman, Jacksonville, Ill.

[73] Assignee: Proco, Inc., Jacksonville, Ill.

[21] Appl. No.: 08/379,793

[22] Filed: Jan. 27, 1995

[51] Int. Cl.[7] ..... A47B 9/00

[52] U.S. Cl. ..... 108/147; 248/188.3

[58] Field of Search ..... 108/147, 144, 108/106; 248/188.3, 188.2, 188.4

[56] References Cited

U.S. PATENT DOCUMENTS

| | | | |
|---|---|---|---|
| 2,552,941 | 5/1951 | Courtney . | |
| 2,635,838 | 4/1953 | Branson . | |
| 3,043,049 | 7/1962 | Gleason . | |
| 3,768,766 | 10/1973 | Bain . | |
| 3,795,378 | 3/1974 | Clarke | 248/188.3 X |
| 3,850,395 | 11/1974 | O'Connor | 248/188.3 X |
| 4,257,618 | 3/1981 | Tax et al. . | |
| 4,445,671 | 5/1984 | Reuschenbach et al. | 108/144 X |
| 4,497,390 | 2/1985 | Wilson . | |
| 4,592,590 | 6/1986 | Slaats et al. | 108/147 X |
| 4,593,951 | 6/1986 | Slaats et al. | 108/147 X |
| 4,754,713 | 7/1988 | Chatenay épouse Compagnone | 108/144 |
| 4,784,362 | 11/1988 | Wang | 248/188.3 X |
| 5,044,468 | 9/1991 | Worthington, Jr. | 248/188.3 X |
| 5,320,047 | 6/1994 | Deurloo et al. | 108/147 X |

*Primary Examiner*—Jose V. Chen
*Attorney, Agent, or Firm*—Armstrong Teasdale LLP

[57] ABSTRACT

A table having a plurality of supports, each with a foot thereon, has interconnected cylinders mounted on two adjacent supports, with the fee mounted on the cylinder's pistons to allow the feet to extend or retract relative to their respective supports. Because the cylinders are interconnected, the pistons, and the feet mounted thereon, move equally and oppositely of each other, until both contact the floor thereby stabilizing the table. A stabilizing device for tables includes two fluid cylinders interconnected by a conduit, adapted to be installed on adjacent supports, so that the cylinders' pistons can move inwardly and outwardly with respect to the supports on which the pistons are mounted. A method of stabilizing tables includes the step of installing interconnected fluid cylinders on adjacent supports of a table, with the pistons of the cylinders mounting the feet, so that the feet can move inwardly and outwardly with respect to supports, equally and oppositely of each other, until the feet on both pistons engage the floor, to stabilize the table.

8 Claims, 2 Drawing Sheets

STABILIZED TABLE, STABILIZER FOR TABLES, AND METHOD OF STABILIZING TABLES

BACKGROUND AND SUMMARY OF THE INVENTION

This invention relates to a stabilized table that resists rocking on uneven floors, a stabilizer for mounting on tables so that they resist rocking on uneven floors, and a method of stabilizing tables on uneven floors.

A continuing problem with tables is the fact that they rock or wobble on uneven floors. The legs or supports of tables are often provided with adjustable feet to level the table and stop the table from wobbling. This typically requires that feet be individually adjusted. It is a time consuming and tedious task to individually adjust the feet to level and stabilize the table, and the process must be repeated each time the table is moved.

The present invention provides a stabilized table that automatically adjusts to accommodate the unevenness of the floor, to reduce or eliminate wobbling. The present invention also provides a stabilizer device that can be mounted on a table to allow the table to automatically stabilize the table and reduce or eliminate wobbling. Finally, the present invention provides a method for stabilizing tables on uneven floors.

The table of the present invention generally comprises a table surface and a plurality of supports. Each of the supports has a foot portion for contacting the floor. According to the improvement of this invention, two interconnected fluid cylinders are incorporated into two adjacent supports. The feet are mounted on the cylinders' pistons to allow the feet to extend or retract relative to their respective supports. Because the cylinders are interconnected, the pistons, and thus the feet mounted thereon, move equally and oppositely of each other. The movement of the feet automatically adjusts the supports to stabilize the table from wobbling. While the table is not necessarily level, it resists wobbling.

The stabilizer device of the present invention is adapted for installation on a table having a plurality of supports to stabilize the table on an uneven floor. Generally, the stabilizer device comprising two fluid cylinders, interconnected by a conduit, adapted to be installed on adjacent supports. The cylinders' pistons can move inwardly and outwardly with respect to the supports on which they are mounted. Because the cylinders are interconnected, the pistons move equally and oppositely of each other, to automatically stabilize the table from wobbling. While the device does not necessarily level the table, it causes the table to resist wobbling.

The method of stabilizing a table of the present invention applies to tables of the type having a plurality of supports each having a foot contacting the floor. Generally, the method comprises the steps of installing interconnected fluid cylinders on adjacent supports, with the pistons of the cylinders mounting the feet. Because the cylinders are interconnected, the pistons and thus the feet mounted thereon, move equally and oppositely of each other. The movement of the feet automatically adjusts the supports to stabilize the table from wobbling. While the table is not necessarily level, it resists wobbling.

The table of the present invention quickly and automatically accommodates unevenness in the floor, to reduce or eliminate wobbling. Similarly the stabilizer device of the present invention is adapted to be retrofit to existing tables, and quickly and automatically accommodates unevenness in the floor, to reduce or eliminate wobbling. Finally, the method of stabilizing tables of the present invention applies to new or existing tables, and allows the table to quickly and automatically accommodate unevenness in the floor. Although the tables stabilized according to the present invention are not necessarily level, the table resists wobbling because the pistons of the cylinders on the adjacent supports accommodate unevenness in the floor, extending and retracting equally and oppositely to stabilize the table. This invention is of simple and reliable construction, and is inexpensive to implement.

These and others features and advantages will be in part apparent and in part pointed out hereinafter.

BRIEF DESCRIPTION OF THE DRAWINGS

Corresponding reference numerals indicate corresponding parts throughout the several views of the drawings.

DETAILED DESCRIPTION OF THE PREFERRED EMBODIMENT

Figure 1:
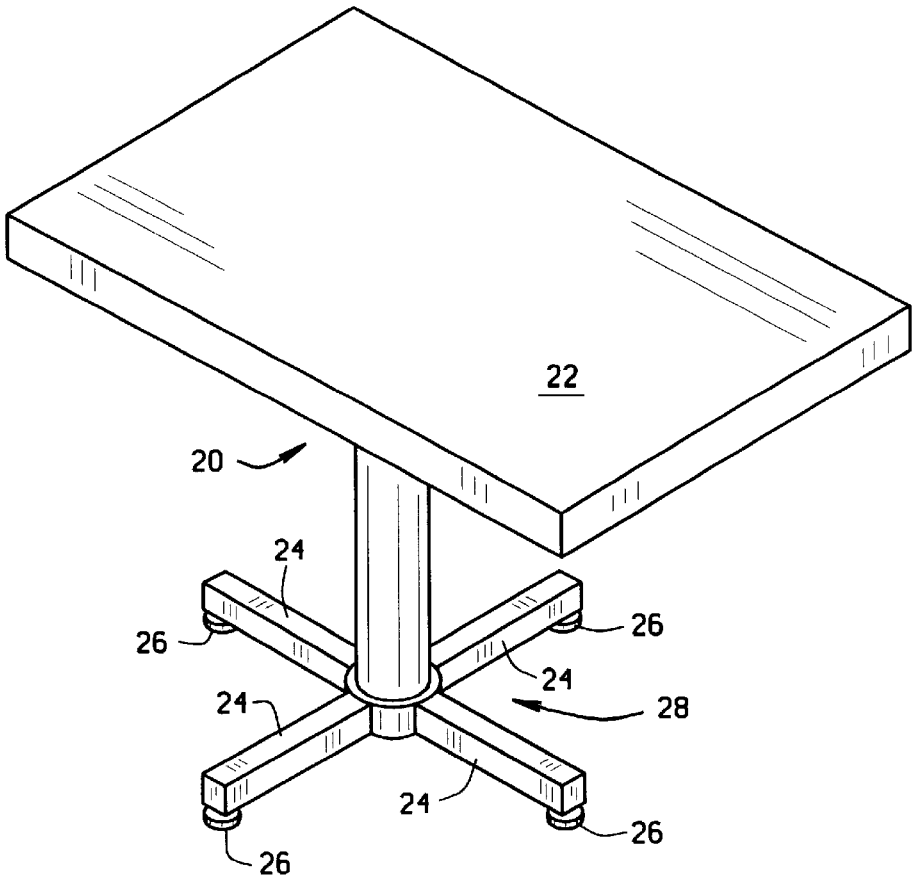
FIG. 1 is a perspective view of a table incorporating a stabilizer device constructed according to the principles of this invention.

A table constructed according to the principles of the present invention is indicated generally as 20 in FIG. 1. The table 20 comprises a table top 22, and a plurality of supports 24, each having a foot 26 thereon for contacting the floor. As used herein, table means any generally flat work surface supported by a plurality of supports or legs, including work tables and benches, dining tables, serving tables, saw tables, drill tables, etc. In this preferred embodiment the supports 24 are part of a generally star-shaped base 28, connected to the table top 22. However, the table could be of some other construction, for example the supports could comprise conventional table legs depending from the table top 22, and the foot could simply be the bearing surfaces on the bottoms of the legs.

Figure 2:
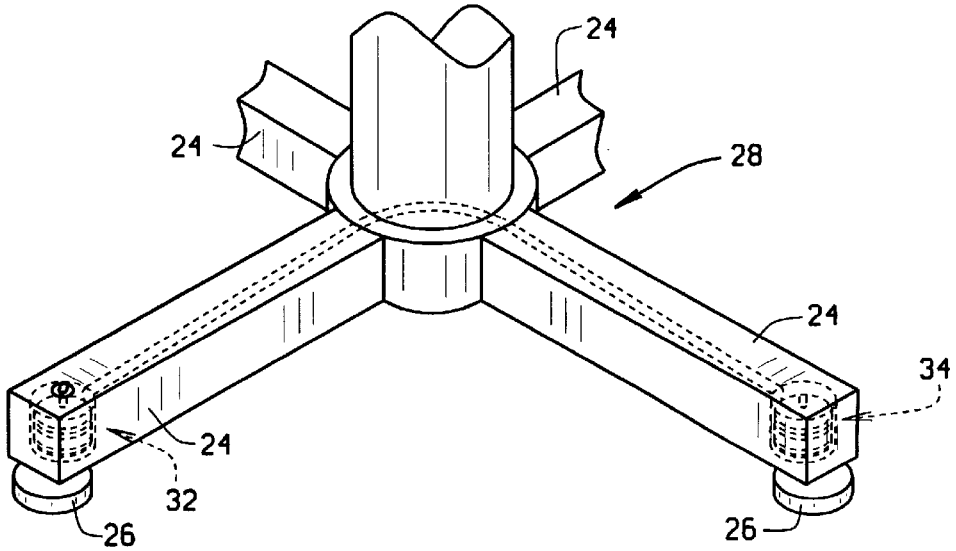
FIG. 2 is an enlarged perspective view of the base of the table shown in FIG. 1.
Figure 3:
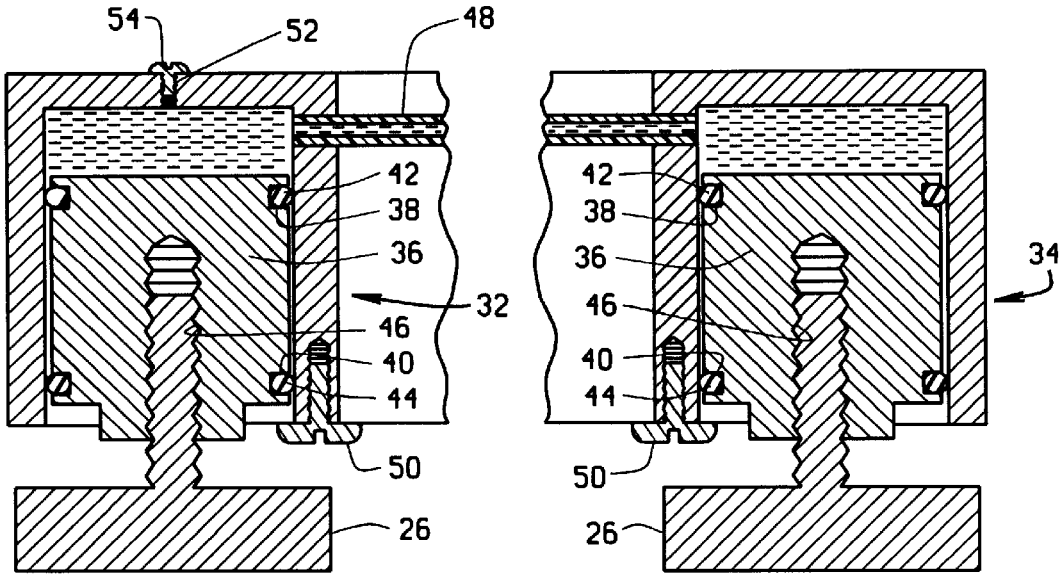
FIG. 3 is a partial cross-sectional view of the stabilizer mechanism incorporated into the base of the table shown in FIGS. 1 and 2.

As best shown in FIGS. 2 and 3, the table 20 includes a stabilizer device constructed according to the principles of this invention. In this preferred embodiment, the stabilizer device comprises two interconnected fluid cylinders 32 and 34 incorporated into adjacent supports. The cylinders can be formed in the supports 26, or can be made separate and secured to the supports. The cylinders 32 and 34 each comprise a piston 36 that reciprocates in within its respective cylinder. Each piston 36 has circumferential grooves 38 and 40 in the sidewall, adjacent the top and bottom for mounting O-rings 42 and 44. The O-rings sealingly engage the inside of the cylinder bore, to permit the piston to slide in the bore without leaking. Each piston has a threaded bore 46 in its bottom for threadedly mounting a foot 26. The cylinders 32 and 34 are interconnected with a conduit 48, and filled with a fluid such as oil, so that the pistons (and thus the feet 26 mounted thereon) move equally but oppositely. The movement of the pistons accommodates the unevenness of the floor, as the pistons move relative to each other until both are in contact with the floor. This reduces or eliminates the wobble, although table may not necessarily be perfectly level.

Each cylinder has a screw 50 that helps retain the piston 36 in the cylinder's bore. At least one of the cylinders has an access opening 52, closed with a screw 54, allowing the cylinders and conduit to be charged or refilled with oil or other suitable fluid.

Figure 4:
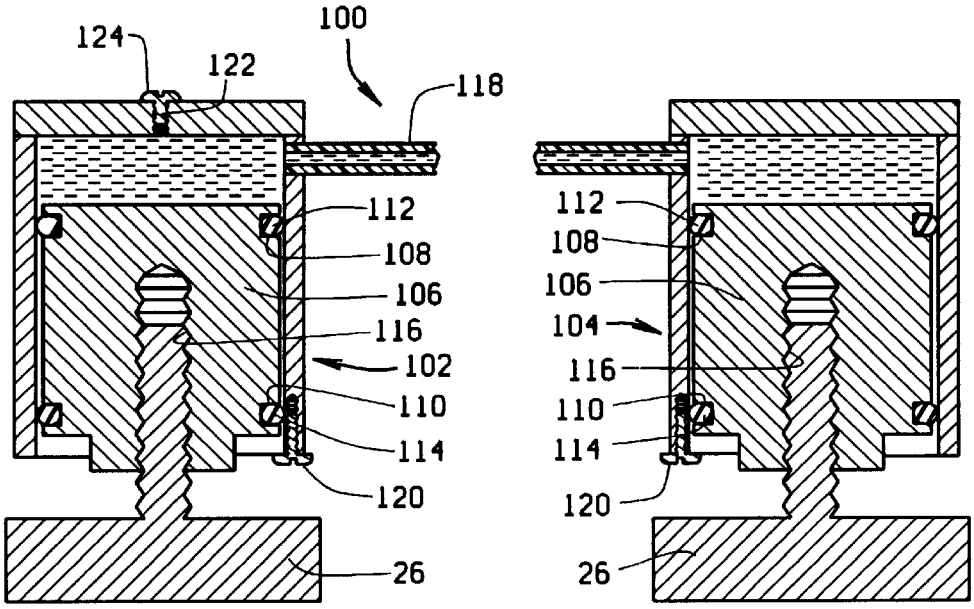
FIG. 4 is a cross sectional view of a stabilizer device constructed according to the principles of this invention, adapted for mounting onto the adjacent supports of a table.

The stabilizer device of the present invention is indicated generally as 100 in FIG. 4. The stabilizer device is adapted to be installed on a table having a plurality of supports, such as the supports 26 on the table 20 described above, or such as legs depending from the table top. The stabilizer device stabilizes the table on an uneven floor. The stabilizer device comprises two inconnected fluid cylinders 102 and 104 adapted for mounting on two adjacent supports. The cylinders 102 and 104 each comprise a piston 106 that reciprocates in within its respective cylinder. Each piston 106 has circumferential grooves 108 and 110 in the sidewall, adjacent the top and bottom for mounting O-rings 112 and 114. The O-rings sealingly engage the inside of the cylinder bore, to permit the piston to slide in the bore without leaking. Each piston has a threaded bore 116 in its bottom for threadedly mounting a foot 26. The cylinders 112 and 114 are interconnected with a conduit 118, and filled with a fluid such as oil, so that the pistons (and thus the feet 26 mounted thereon) move equally but oppositely. The movement of the pistons accommodates the unevenness of the floor, as the pistons move relative to each other until both are in contact with the floor. This reduces or eliminates the wobble, although table is not necessarily perfectly level.

Each cylinder has a screw 120 that helps retain the piston 106 in the cylinder's base. At least one of the cylinders has an access opening 122, closed with a screw 124, allowing the cylinders to be changed or refilled with oil or other suitable fluid.

The method of stabilizing tables of this invention applies to tables having a plurality of supports each having a foot contacting the floor. The method comprises the steps of installing interconnected fluid cylinders on adjacent supports, with the pistons of the cylinders mounting the feet, so that the feet can move inwardly and outwardly with respect to supports, equally and oppositely of each other, to stabilize the table.

OPERATION

In operation, the table 20 is simply placed in the desired location on a floor. The pistons in the cylinders 32 and 34 move to accommodate unevenness in the floor, until the feet on both pistons are in contact with the floor, stabilizing the table from wobbling.

Similarly, the stabilizing device 100 of the present invention is quickly and easily installed on a table by mounting the fluid cylinders 102 and 104 on two adjacent supports. The feet on the pistons in the cylinders 102 and 104 move to accommodate unevenness in the floor, until the feet on both pistons are in contact with the floor, stabilizing the table from wobbling.

Finally, according to the method of this invention interconnected cylinders are installed on two adjacent supports on a table. The pistons in the cylinders move to accommodate unevenness in the floor, until the feet on both pistons are in contact with the floor, stabilizing the table from wobbling.

What is claimed is:

1. In a table having at least three supports, each support having a contact surface for contacting the floor, the improvement comprising two fluid cylinders, each cylinder comprising a bore with a piston slidably mounted therein, one cylinder incorporated into each of two supports, with the contact surface on the cylinder's piston, the cylinders in fluid communication to allow the contact surfaces to extend or retract relative to the their respective supports, equally and oppositely of each other, to stabilize the table.

2. The table according to claim 1 wherein the cylinders are incorporated into a adjacent supports.

3. The table according to claim 2 wherein the table has four supports.

4. The table according to claim 1 wherein the table has four supports.

5. A stabilizer device for installation on a table having a plurality of supports to stabilize the table on an uneven floor, the device comprising two fluid cylinders, each cylinder comprising a bore with a piston slidably mounted therein, the cylinder being interconnected by a conduit so that they are in fluid communication, and adapted to be installed on two of the supports, so that the cylinders' pistons can move inwardly and outwardly with respect to the supports on which the cylinders are mounted, equally and oppositely of each other, to, stabilize the table.

6. A method of stabilizing a table having a plurality of supports each having a contact surface for contacting the floor, the method comprising the steps of installing fluid-interconnected fluid cylinders on two of the supports, each cylinder comprising a bore with a piston slidably mounted therein, with the pistons of the cylinders mounting the contact surfaces on their respective supports, so that the contact surfaces can more inwardly and outwardly with respect to supports, equally and oppositely of each other, to stabilize the table.

7. A method according to claim 6 wherein the cylinders are installed on adjacent supports.

8. The method according to claim 6 wherein the table has four supports.

* * * * *